US006325633B1

(12) United States Patent
Ito et al.

(10) Patent No.: US 6,325,633 B1
(45) Date of Patent: Dec. 4, 2001

(54) CONNECTION STRUCTURE FOR POWER SUPPLY TO VEHICLE DOOR

(75) Inventors: Hidetaka Ito; Kikuo Ogawa, both of Shizuoka; Shigeo Shigeyama, Aichi; Kenji Kotani, Aichi; Katsuaki Kawahata, Aichi, all of (JP)

(73) Assignee: Yazaki Corp., Tokyo (JP)

( * ) Notice: Subject to any disclaimer, the term of this patent is extended or adjusted under 35 U.S.C. 154(b) by 0 days.

(21) Appl. No.: 09/526,178

(22) Filed: Mar. 15, 2000

(30) Foreign Application Priority Data

Aug. 24, 1998 (JP) ..... 10-236648

(51) Int. Cl.[7] ..... H01R 13/64
(52) U.S. Cl. ..... 439/34; 439/246
(58) Field of Search ..... 439/34, 263, 259, 439/341, 338, 839, 246

(56) References Cited

U.S. PATENT DOCUMENTS 5,664,972 * 9/1997 Zinn et al. ..... 439/839
5,938,486 * 8/1999 Durand-cochet et al. ..... 439/839
6,142,810 * 11/2000 Hsiao et al. ..... 439/246

FOREIGN PATENT DOCUMENTS 57-47444 3/1982 (JP) .

* cited by examiner

*Primary Examiner*—Gary Paumen
(74) *Attorney, Agent, or Firm*—Armstrong, Westerman, Hattori, McLeland and Naughton, LLP

(57) ABSTRACT

A connection structure for power supply to a vehicle door including a door side connector 4, a body side connector 3, a plurality of female terminals 9 provided in parallel in either one of the connectors, and a plurality of male terminals 46 corresponding to the female terminals provided in parallel in the other of the connectors, the female terminals 9 and the male terminals 46 being connected to each other when the door is closed, the female terminals 9 being arranged close to one another and synchronously swingable around a support shaft 15 in a direction of axial displacement with respect to the male terminals 46. The connection structure further includes a spring member 16 for forcing a pair of contact portions 20 of each of the female terminals 9 into a closed state, the spring member 16 including a pair of leg portions **16*b*1, 16*b*2 which are in abutment against spring receiving walls 36 of a housing 8 of either one of the connectors. With this structure, the connectors 3 and 4** can be downsized in both width and length, and the axial displacement of the terminals will be avoided.

2 Claims, 7 Drawing Sheets

CONNECTION STRUCTURE FOR POWER SUPPLY TO VEHICLE DOOR

BACKGROUND OF THE INVENTION

1. Field of the Invention

The present invention relates to a connection structure for a power supply to a vehicle door for supplying electric power of a vehicle body to auxiliary members in a back door, etc., of an automobile, which can be downsized particularly by abolishing partition walls between female terminals.

2. Description of the Related Art

Generally, various auxiliary members, such as a rear wiper motor, a defogger, a door lock, etc., are mounted on a back door of an automobile, and there have been proposed a number of connection structures for power supply to a vehicle door.

FIG. 9 shows a conventional connection structure for power supply to the vehicle door as described in Japanese Utility Model Publication No. 57-47444 of an unexamined application. As shown in FIG. 9, a plurality of pin-like movable terminals 66 are provided on a back door 65 of a vehicle so as to be retractable by means of coil springs 67, and contact terminals 69 are provided on a vehicle body 68 so as to face with tip ends 66*a* of the movable terminals 66, respectively.

The movable terminals 66 are arranged in a row at a distance in an insulating housing 70. A forward portion of each of the movable terminals 66 projecting from the housing 70 is covered with an insulating holder 71 to expose only its tip end 66*a*. The holder 71 is slidably fitted in a bore 72 in the housing 70. The above mentioned coil spring 67 is disposed in the bore 72.

The contact terminals 69 are positioned in an insulating housing 73 between the partition walls 74. One (691) of the contact terminals 69 has a cancel switch mechanism 76 which is forced by a coil spring 75 so as not to contact with a contact when the door is open.

The tip ends 66*a* of the movable terminals 66 enter into a chamber 77 which is separated by the partition walls 74 and push the contact terminals 69. At the same time, the contact terminal 691 comes in contact with the contact 78 thereby to connect a power source side circuit 79 to a circuit of the auxiliary devices (not shown).

However, in the above described structure, the movable terminal 66 is apt to diametrically offset on occasion of the contact due to its long size, and it has been necessary to make an area of the contact terminal 69 and the distance between the movable terminals 66 larger in order to obtain a good contact even in such cases. For this reason, there has been a problem that the structure will be up-sized in a lateral direction (in a direction in which the terminals are arranged). In addition, it has been disadvantageous that the cancel switch mechanism 76 may be deteriorated in contactability when the contact 78 is tilted and offset and may cause a bad contact.

In view of the above described problems, it is an object of the invention to provide a connecting structure for power supply to a vehicle door in which upsizing in a direction of arranging a plurality of terminals when they are arranged in a row will be prevented, and which is compact and excellent in contactability.

SUMMARY OF THE INVENTION

In order to attain the above described object, there is provided, according to the present invention, a connection structure for power supply to a vehicle door comprising a door side connector, a body side connector, a plurality of female terminals provided in parallel in either one of the connectors, and a plurality of female terminals corresponding to the female terminals provided in parallel in the other of the connectors, the female terminals and the male terminals being connected to each other when the door is closed, the female terminals being arranged close to one another and synchronously swingable around a support shaft in a direction of axial displacement with respect to the male terminals.

The connection structure for power supply to the vehicle door further comprises a spring member for forcing a pair of contact portions of each of the female terminals into a closed state, the spring member including a pair of leg portions which are in the abutment against spring receiving walls of a housing of either one of connectors.

DESCRIPTION OF THE PREFERRED EMBODIMENT

Figure 1:
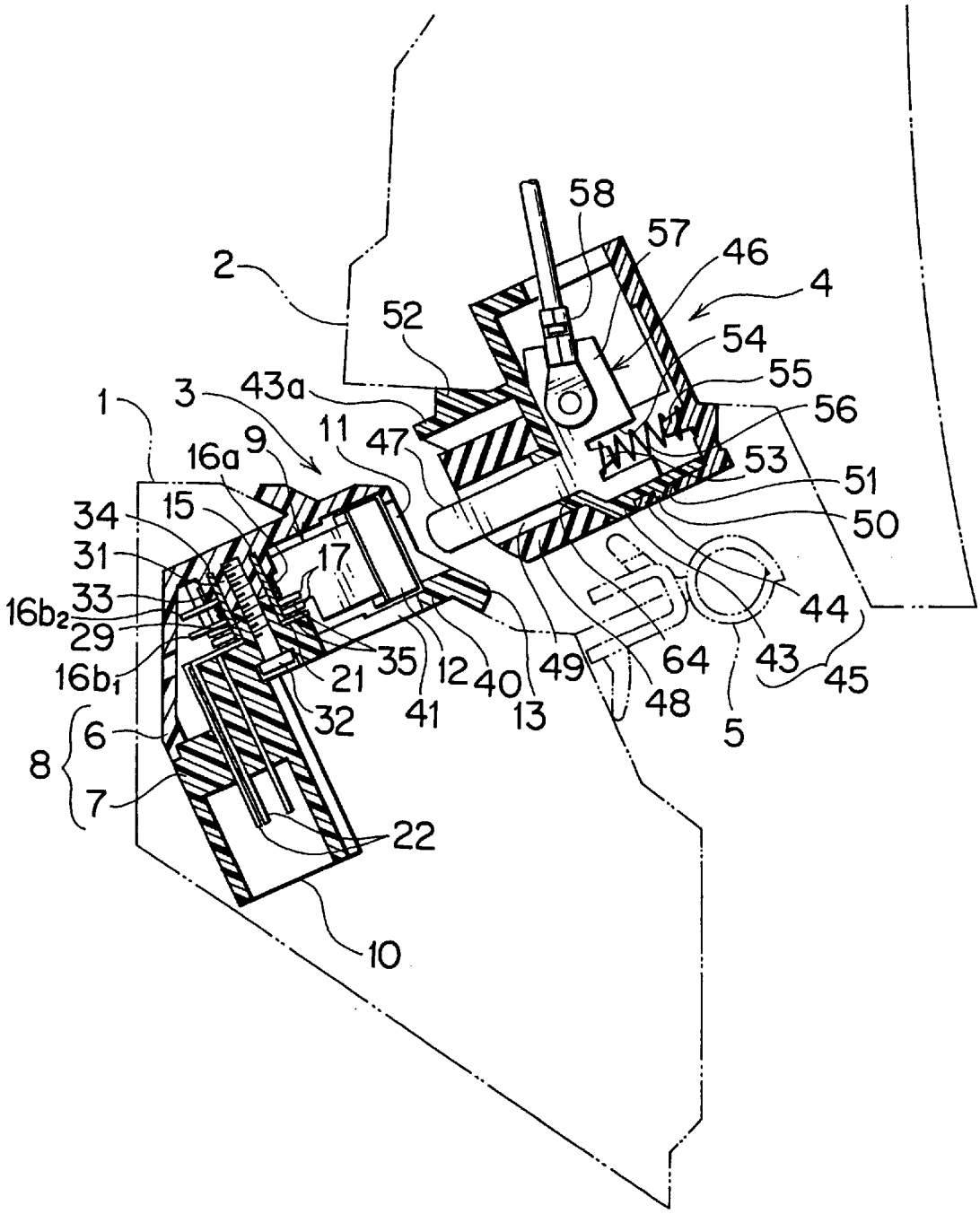
FIG. 1 is a side view in a vertical section illustrating one embodiment of a connecting structure for power supply to a vehicle door according to the invention.

Now, an embodiment of the present invention will be described by way of example referring to the drawings.

FIGS. 1 to 8 show an embodiment of the connecting structure for power supply to the vehicle door according to the invention.

Figure 2:
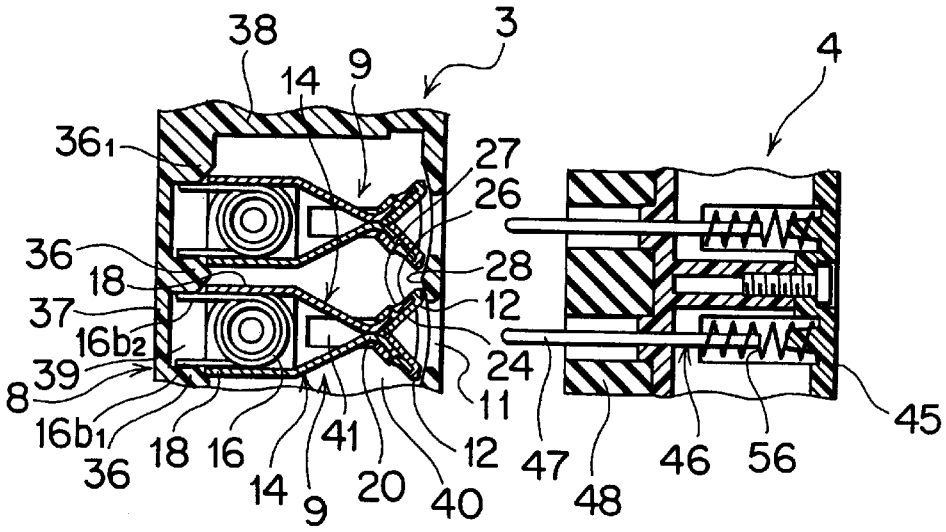
FIG. 2 is a plan view in a lateral section showing an arrangement of terminals in respective connectors when a door is open.

In FIGS. 1 and 2, reference numeral 1 represents a vehicle body, 2 represents a back door of the vehicle when it is open, 3 represents a body side connector provided in the vehicle body (a body side switch), 4 represents a door side connector provided on the back door 2 (a door side switch), and 5 represents a weather strip respectively.

The body side connector 3 includes a housing 8 formed of an insulating resin and a plurality of female terminals 9 which are contained in parallel in the housing 8 and close to one another. The housing 8 consists of an upper cover 6 and a lower case 7. A female connector part 10 to be connected to a power source wire is integrally provided in a backward half of the case 7.

The housing 8 has a plurality of openings 11 into which a plurality of male terminals are adapted to be inserted.

Inside the openings 11 are contained the female terminals 9, respectively. The openings 11 are respectively closed by a plurality of shutters 12 formed of a synthetic resin and fitted to the female terminals 9. The housing 8 is fixed to the vehicle body 1 by means of a slanted flange 13.

Each of the female terminals 9 inside the body side connector 3 is composed of a pair of contact members 14, 14 (FIG. 2). Each pair of the contact members 14, 14 are supported by a cylindrical shaft (a support shaft) 15 formed of a metal so as to be opened and closed, and forced in a closing direction by means of a torsion coil spring (a spring member) 16 provided around the cylindrical shaft 15.

Figure 3:
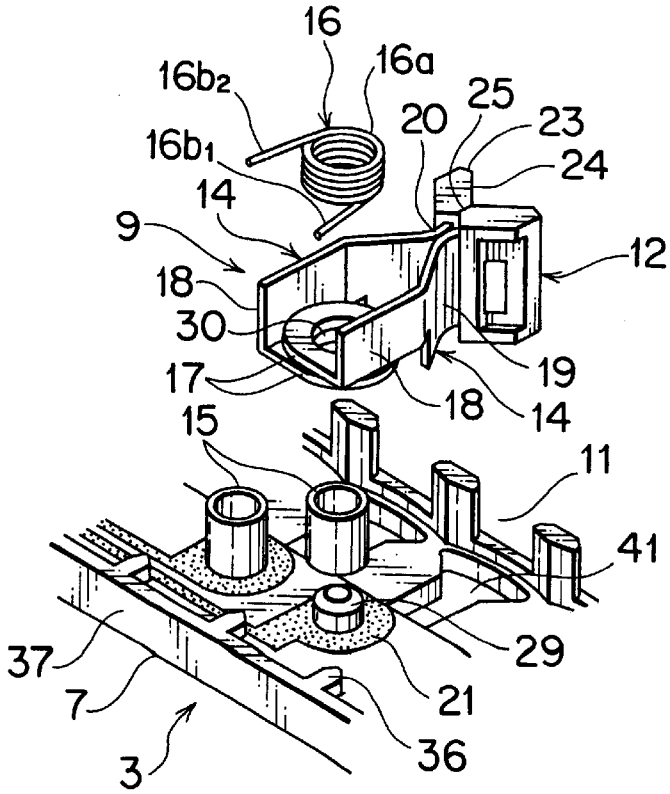
FIG. 3 is an exploded perspective view showing a state wherein female terminals are mounted on a body side connector.

As shown in FIG. 3, the torsion coil spring 16 consists of a coiled portion 16*a* and a pair of leg portions 16$b_1$, 16$b_2$ extending backwardly beyond the coiled portion 16*a*. Each pair of the contact members 14 of the female terminal 9 are composed of a pair of horizontal hinge portions 17, side plates 18 projecting upright from the hinge portions 17, slanted portions 19 which are forwardly slanted from the side plates 18, and contact portions 20 continuing from the slanted portions 19.

A pair of the hinge portions 17 in a stacked state are abutted against an electrode 21 in the housing 8 by means of the coiled portion 16*a* of the torsion coil spring 16. The torsion coil spring 16 performs simultaneously both actions of pressing the contact portions 20 (FIG. 2) and pressing the hinge portion 17 toward the electrode 21. The electrode 21 is integral with a tab terminal 22 in the female connector part 10 (FIG. 1), and the tab terminal 22 is connected to the power source wire which is not shown.

As shown in FIG. 2, the shutters 12 are fixed to forward ends of the contact members 14 and adapted to be freely opened and closed integrally with the contact portions 20. As shown in FIG. 3, the stutters 12 have narrow tip end faces 23, guide faces 24 which are tapered inwardly from the tip end faces 23, and closed faces 25 to be fitted to each other at inner edges of the guide faces 24. When both the contact portions 20 are in contact with each other, both the closed faces 25 are also fitted to each other, and will prevent dusts, water drops, etc. from intruding into the opening 11 of the housing 8 (FIG. 2) to keep the contact portions 20 clean. As shown in FIG. 2, the shutters 12 are introduced along slanted forward ends 26 of the contact portions 20 and locked by locking claws 27. The shutters 12 can slide along curved inner faces 28 at both sides of the opening 11 of the housing 8, and always keep the opening shut.

As shown in FIG. 3, each of the cylindrical shaft 15 fits over a boss 29 inside the case 7. Around the boss 29, is provided the electrode 21 which is integral with the tab terminal 22 of the female connector part 10 (FIG. 1). The cylindrical shaft 15 is fitted in an axial bore 30 which is formed in the stacked hinge portions 17 of the female terminal 9. The cylindrical shaft 15 prevents sliding wear or deformation of the boss 29 and the axial bore 30.

As shown in FIG. 1, the case 7 and the cover 6 are fixed together with a small bolt 32 at a center of their bosses 29, 31 in a state where the bosses 29, 31 are mated together. The above described cylindrical shaft 15 is fitted around the bosses 29, 31 respectively.

As seen in FIG. 1, the coiled portion 16*a* of the torsion coil spring 16 is pressed by an outer seat 33 of the boss 31 of the cover 6. Between the boss 31 and the seat 33, is formed a groove 34 into which the cylindrical shaft is inserted. The upper hinge portion 17 and the electrode 21 are provided with contacts 35, and the lower hinge portion 17 is in contact with the electrode 21 by means of the contact 35.

The coiled portion 16*a* engages around the cylindrical shaft 15, and a pair of the left and right leg portions 16$b_1$, 16$b_2$ are in contact with the side plates (a spring receiving part) 18 of the contact members 14 as shown in FIG. 2, and backwardly extend beyond the side plates 18 to be abutted against spring receiving walls 36 in the housing 8. The spring receiving walls 36 project perpendicularly from a back wall 37 of the housing 8 as shown in FIG. 3. At both sides of the housing 8, the spring receiving walls 361 are formed integrally with the back wall 37 and the side walls 38 as seen in FIG. 2. Between the adjacent spring receiving walls 36, is formed a hollow groove 39 into which a pair of the leg portions 16$b_1$, 16$b_2$ are inserted.

The leg portions 16*b* of the torsion coil spring 16 push the side plates 18 of the contact members 14 outwardly within a range where they abut against the spring receiving walls 36, and push the contact portions 20 and the shutters 12 in a closing direction with an appropriate (not too strong) force. By pushing the left and the right spring receiving walls 36 with a constant force by a pair of the left and the right leg portions 16$b_1$, 16$b_2$, centering of the female terminal 9 will be performed. Thus, the position of the female terminal 9 can be accurately set so that a center of a pair of the shutters 12 at the forward side will be positioned at a center of the opening 11.

As shown in FIGS. 2 and 3, the side plates 18 of the adjacent female terminals 9 inside the housing 8 are separated from each other by a thickness of the spring receiving wall 36. Because the thickness of the spring receiving wall 36 is very small, the adjacent female terminals 9 are arranged close to each other. Between the adjacent female terminals 9, there is provided no partition wall for constituting a terminal receiving chamber. A gap between the adjacent shutters 12 is also very small.

As seen in FIGS. 2 and 3, there are formed openings 41 for draining water and removing dust in a bottom wall 40 of the housing 8 below the female terminals 9. A forward area of each of the openings 41 is made larger in which according to the shape of the shutter 12 so that the water drops and dusts received by the shutter 12 as well as the dust or the like caused by abrasion when the male terminal is inserted, may fall through the opening 41 and may not stay in the housing 8.

In FIGS. 1 and 2, the door side connector 4 is composed of a housing 45 formed of an insulating synthetic resin, a plurality of male terminals 46 which are forced by springs in a projecting direction inside the housing 45 and have electric contact portions 47, and cushions 48 formed of rubber or the like and provided around the electric contact portions 47 of the male terminals 46 so as to face with the body side connector 3. The housing 45 consists of a front case 43 and a back cover 44. The male terminals 46 are mounted in a state where the cover 44 has been detached.

The cushions 48 are provided in a front part of the case 43. The electric contact portion 47 of each of the male terminals 46 is passed through a hollow part 49 in the cushion 48 and a tip end of the electric contact portion 47 projects outward of the cushion 48. The electric contact portion 47 projects from a boss 64 of the case 43, and the hollow part 49 is fitted around the boss 64. The case 43 is integrally formed with a hood portion 43*a*covering a front part of the body side housing 8 outside the cushion 48. The cover 44 is fixed to the case 43 by engaging a locking projection 50 in the case 43 with a locking hole 51 in the cover 44. The housing 45 is fixed to the back door 2 by means of a flange portion 52.

The electric contact portion 47 is formed at a base part thereof with a projection 53 for receiving a coil spring and a cutout 54 into which the coil spring is inserted. Between the spring receiving projection 53 and a spring receiving projection 55 of the cover 44, is resiliently provided a compression coil spring 56. A force of the coil spring 56 is set so as to be larger than a force of inserting the electric contact portion 47 into the female terminal 9. The male terminal 46 is adapted to compress the coil spring 56 to retract the electric contact portion 47 inward of the cushion 48 when the electric contact portion 47 has received an accidental outer force. This action will prevent the electric contact portion 47 from being deformed or broken.

The male terminal 46 has a connecting portion 57 which extends upwardly from the base part of the electric contact portion 47, and a terminal 58 provided with an electric wire (wire harness) is connected to the connecting portion 57 by means of screws, etc.

Figure 4:
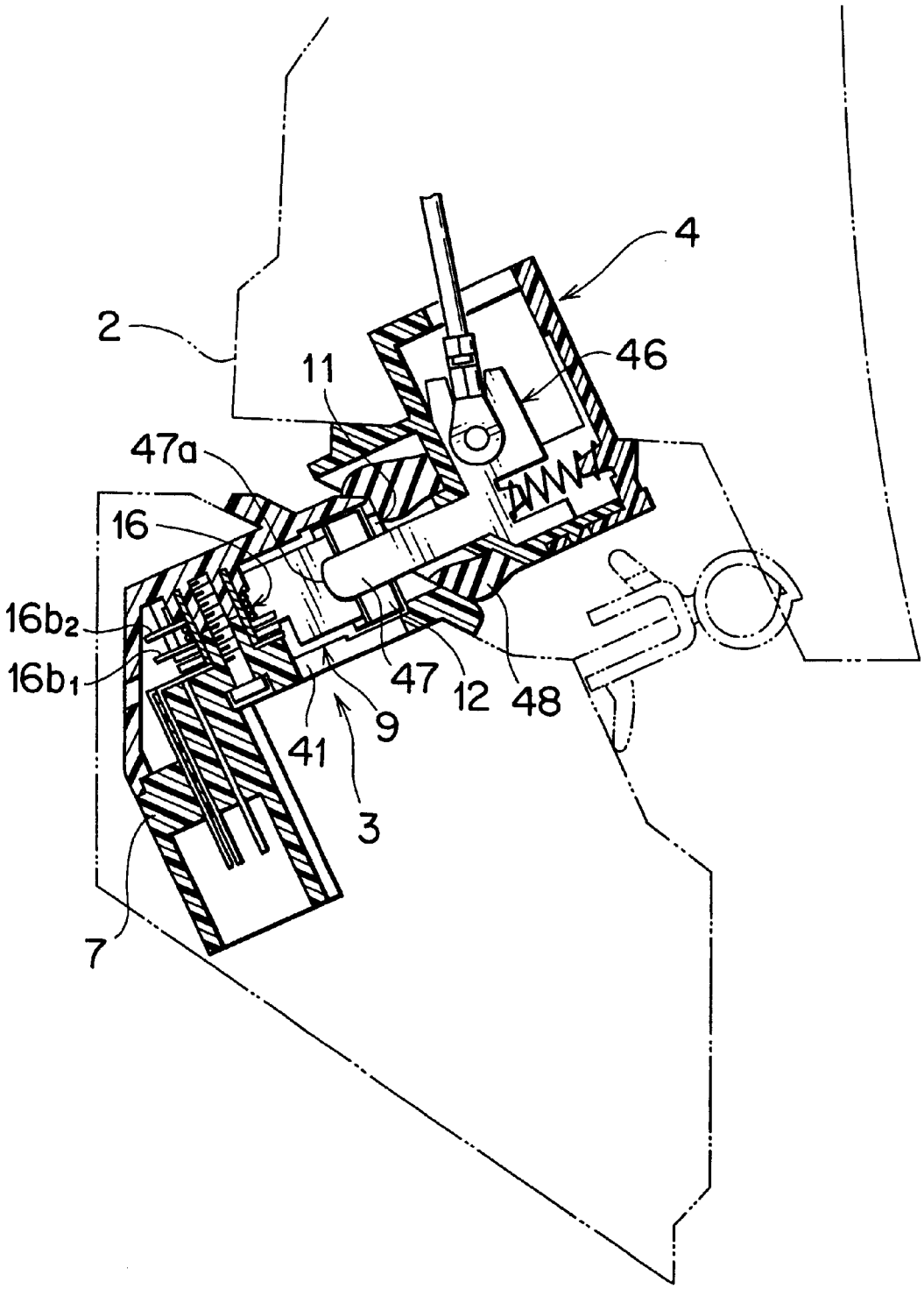
FIG. 4 is a side view in a vertical section showing the terminals in the respective connectors in a connected state when the door is closed.
Figure 5:
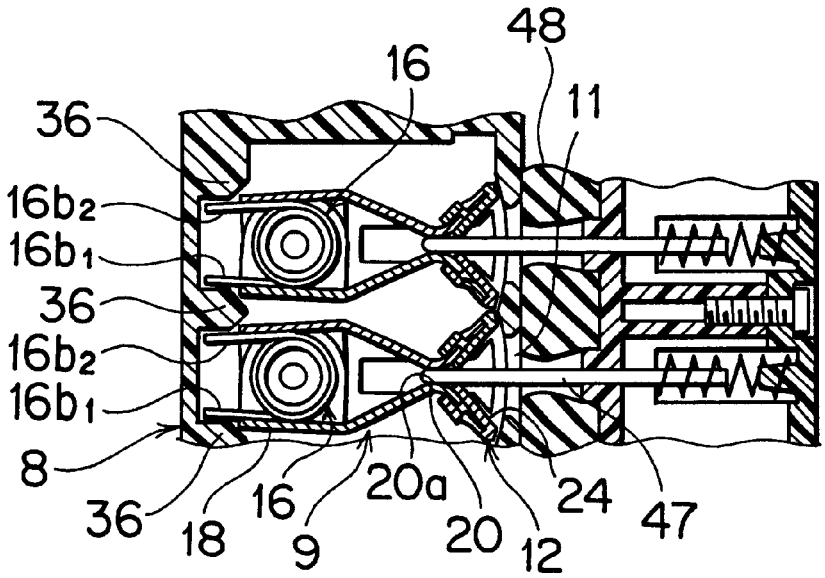
FIG. 5 is a plan view in a lateral section showing the terminal in the connected state when the door is closed.

FIGS. 4 and 5 show a state when the back door 2 is closed from the state in FIG. 1. The electric contact portion 47 of the male terminal 46 in the door side connector 4 is inserted into the female terminal 9 along the guide faces 24 of the shutter 12 of the body side connector 3 and held by a pair of the contact portions 20. The tip end 47*a* of the electric contact portion 47 is positioned slightly beyond the contact faces 20*a*. As a pair of the contact portions 20 of the female terminal 9 are opened outwardly, a pair of the leg portions $16b_1$, $16b_2$ of the torsion coil spring 16 are inwardly pressed with the side plates 18 to be spaced away from the spring receiving walls 36 of the housing 8. With this action, spring forces of a pair of the leg portions $16b_1$, $16b_2$ press the contact portions 20 into a closed position, thus bringing the electric contact portion 47 into contact with the contact portions 20 with a strong contact force. The cushion 48 is sealingly fitted to a front end of the body side connector 3 thereby preventing dusts, water drops and the like from intruding into the opening 11.

Because the contact portions 20 do not open in a vertical direction but open in a horizontal direction, the dusts, abrasion powders and the like will fall down in a vertical direction. In addition, the contact faces 20*a* are cleaned by sliding movements of the electric contact portion 47 of the male terminal 46 both in an inserting and a detaching directions. Thus, the contact faces 20*a* are always kept clean. The dusts and abrasion powders, etc. will be discharged to the exterior through the openings 41 in the case 7.

Figure 6:
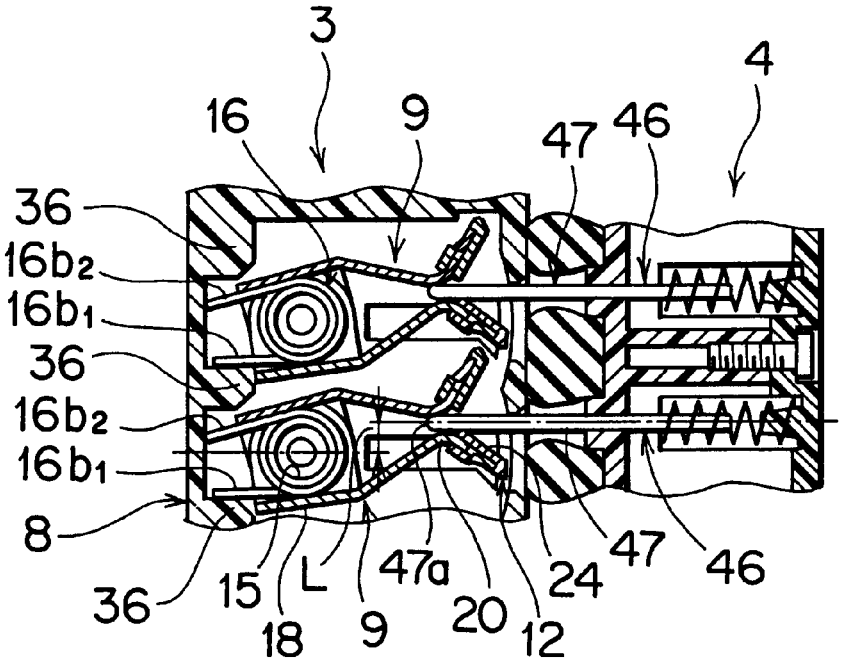
FIG. 6 is a plan view in a lateral section showing the terminals in the connected state in case that they are axially displaced.

FIG. 6 shows the female terminals 9 in th e body side connector 3 and the electric contact portions 47 of the male connectors 46 in the door side connector 4 in a connected state in case where they are axially displaced at an angle L. In this case, because tip end 47*a* of the electric contact portion 47 of each the male terminal 46 is guided along the guide faces 24 of the shutters 12 into the contact portions 20 of each the female terminal 9, and the female terminal 9 rotates around the cylindrical shaft 15 in a direction of the axial displacement thereby to absorb the displacement, a smooth and reliable connection can be attained. The female terminals 9 rotate synchronously with a plurality of the male terminals 46 respectively.

In other words, the female terminal 9 rotates around the cylindrical shaft 15 on a same line as the electric contact portion 47 of the male terminal 46 at a side of the contact portions 20, and at a side of the side plates (the spring receiving parts) 18 rotates in a direction opposite to the rotation direction at the side of the contact portions 20. When the female terminal 9 rotates, one of the leg portions $16b_1$ is strongly abutted against one of the spring receiving walls 36 of the housing 8. Accordingly, a restoring force in a direction opposite to the rotation direction will be given to the female terminal 9. The other leg portion $16b_2$ is greatly separated away from the other spring receiving wall 36.

When the back door 2 (FIG. 4) is opened from the connected state as shown in FIG. 6, to release the connection between the two connectors 3 and 4, the female terminals 9 are synchronously rotated by the spring forces of the torsion coil springs 16 in a restoring direction to be rapidly restored to the original position as shown in FIG. 2. The female terminal 9 can be returned to the original position simply because the one leg portion $16b_1$ of the torsion coil spring 16 is in abutment against the spring receiving wall 36 of the housing 8. Due to the rotation of the terminal along with the axial displacement and the rotation at the restoration, the female terminal 9 swings in a lateral direction.

Because a plurality of the female terminals 9 rotate synchronously in the same direction to absorb the relative axial displacement of the terminals 9 and 46 and a plurality of the female terminals 9 are restored synchronously when the connection is released, the female terminals 9 will not interfere (short circuit) with one another, even if the female terminals 9 and the male terminals 46 are arranged at a fine pitch. Accordingly, a smooth and reliable connection will become possible. By thus arranging the male and the female terminals at the fine pitch, the connectors 3 and 4 can be downsized in width (in a direction perpendicular to the terminal insertion direction).

Figure 9:
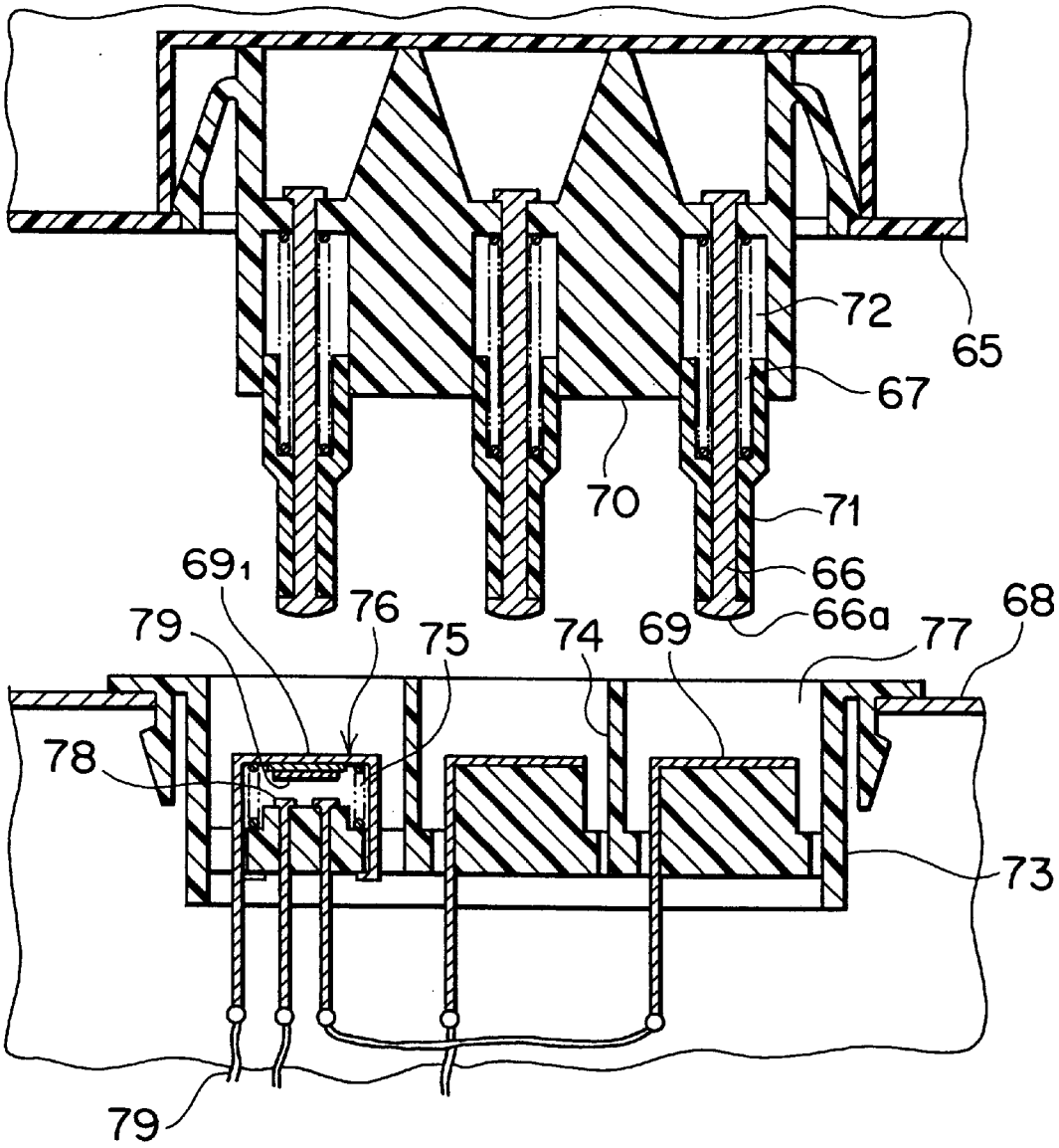
FIG. 9 PRIOR ART
FIG. 9 is a plan view in a lateral section illustrating a conventional example.

With the structure in which tab-shaped or pin-shaped electric contact portions 47 of the male terminals 46 are inserted into the female terminals 9, it is not necessary to support the terminals so as to move in the terminal abutting direction by means of the springs as in the conventional case (FIG. 9). Accordingly, the connectors 3 and 4 can be downsized in a longitudinal direction (the terminal insertion direction) too.

Figure 7:
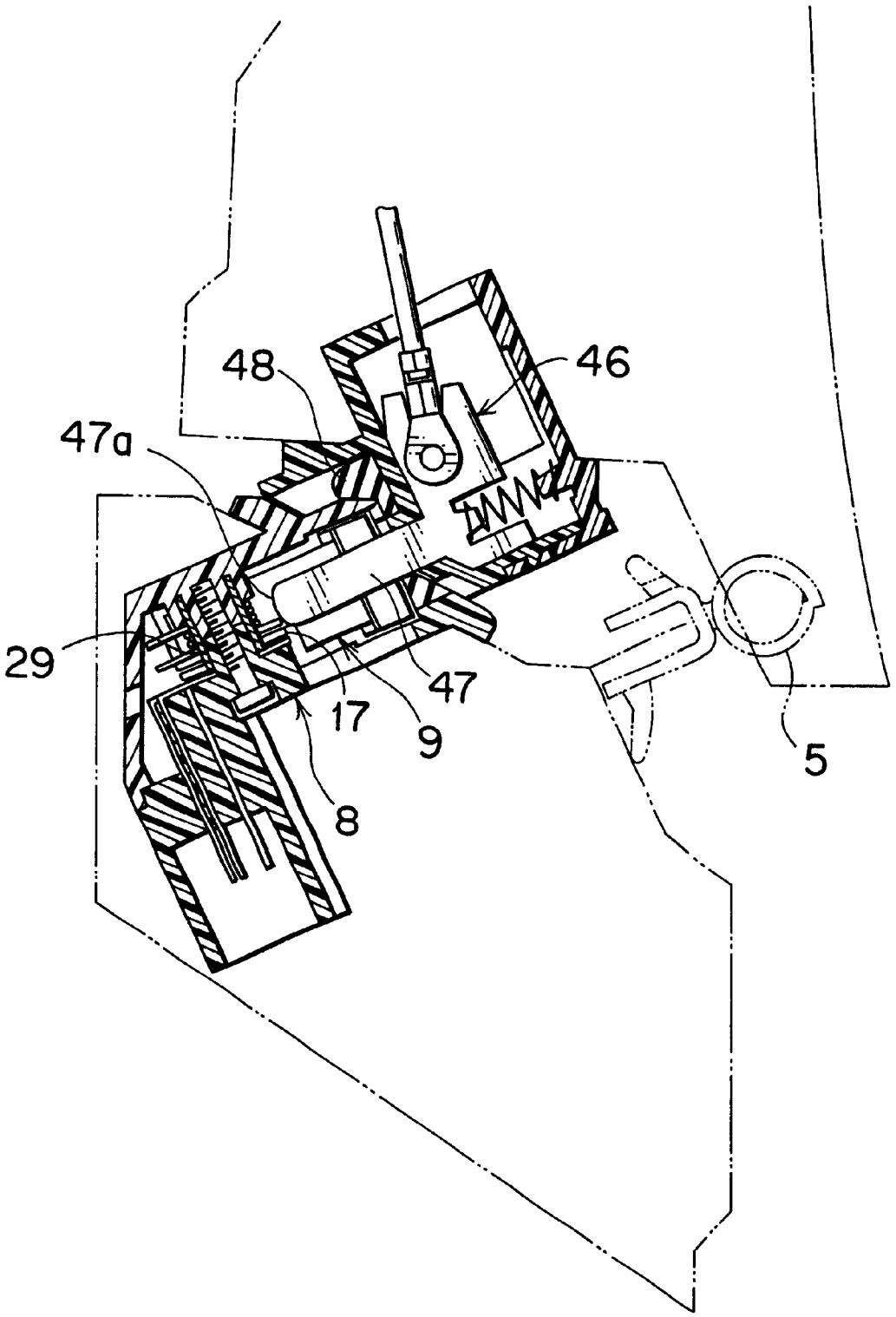
FIG. 7 is a side view in a vertical section showing the connectors in the connected state when they are over stroked.
Figure 8:
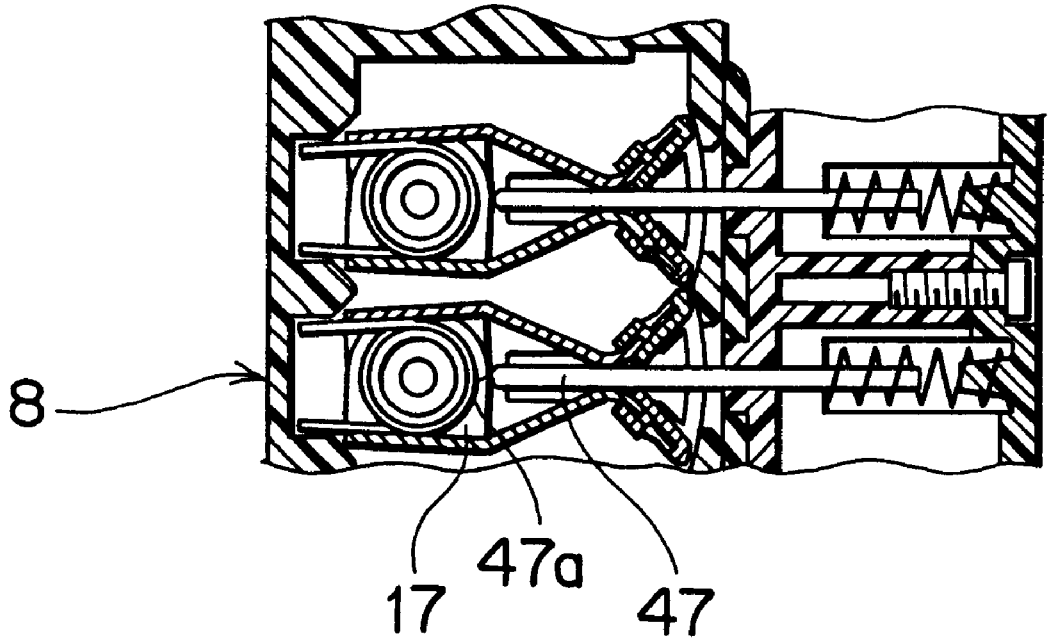
FIG. 8 is a plan view of the terminals in the connected state when the connectors are over stroked.

FIGS. 7 and 8 show a state where the connectors are overstroked with an inertia of the back door when the door is closed from the state as shown in FIGS. 4 and 5. The connectors can be instantly restored to the ordinary closed position as shown in FIGS. 4 and 5 by counter forces of the weather strip 5 and the cushion 48.

On occasion of the over stroke, the tip ends 47*a* of the electric contact portions 47 of the male terminals 46 stop just in front of the hinge portions 17 of the female terminals 9. The position of the bosses 29 of the housing 8 is set so as not to interfere with the hinge portions 17, etc.

It is also possible to replace the door side connector 4 with the body side connector 3 in the structure of the above described embodiment, in such a manner that the door side connector 4 may be provided in the vehicle body and the body side connector 3 in the door. Moreover, the above described structure can be applied not only to the back door but also to a front and a rear doors of the vehicle.

What is claimed is:

1. A connection structure for power supply to a vehicle door, comprising:

a door side connector;

a body side connector;

a plurality of female terminals provided in parallel in either one of said connectors; and a plurality of male terminals corresponding to said female terminals provided in parallel in the other of said connectors, wherein said female terminals and said male terminals are connected to each other when the door is closed, and wherein said female terminals are arranged close to one another and synchronously swingable about a respective support shaft in a direction of axial displacement with respect to said male terminals.

2. The connection structure for power supply to the vehicle door as recited in claim 1, further comprising a spring member for forcing a pair of contact portions of each of said female terminals into a closed state, said spring member including a pair of leg portions which are in abutment against spring receiving walls of a housing of either one of said connectors.

* * * * *